US008196228B1

(12) United States Patent
Gyurjyan

(10) Patent No.: US 8,196,228 B1
(45) Date of Patent: Jun. 12, 2012

(54) PROTECTIVE OVERSIZED TOILET SEAT COVER

(76) Inventor: Garik Gyurjyan, Glendale, CA (US)

( * ) Notice: Subject to any disclaimer, the term of this patent is extended or adjusted under 35 U.S.C. 154(b) by 209 days.

(21) Appl. No.: 12/316,733

(22) Filed: Dec. 16, 2008

(51) Int. Cl.
*A47K 13/14* (2006.01)

(52) U.S. Cl. ..... 4/245.1; 4/245.6

(58) Field of Classification Search ..... 4/245.1, 4/245.3–245.9
See application file for complete search history.

(56) References Cited

U.S. PATENT DOCUMENTS 1,036,323 A * 8/1912 Hopkinson ..... 34/78
1,221,661 A * 4/1917 Bloch ..... 4/245.8
1,522,699 A * 1/1925 Reid ..... 4/245.8
4,352,214 A * 10/1982 Belz ..... 4/245.6
5,557,809 A 9/1996 Adams
5,745,929 A * 5/1998 Sobieralski ..... 4/245.1

* cited by examiner

*Primary Examiner* — Charles Phillips
(74) *Attorney, Agent, or Firm* — William W. Haefliger

(57) ABSTRACT

A protective toilet seat cover comprising in combination a sheet of foldable flexible material having an overall size to cover the toilet, the sheet having a top panel defining a through opening to register with and overlie the toilet bowl, the sheet having opposite side panels configured to hang downwardly at opposite sides of the toilet, the side panels having upright front edges, the sheet having a front panel configured to hang downwardly at the front of the toilet, the front panel having spaced edges that extend upwardly and sidewardly to define front panel upper portions separate from the side panels, and that hang in protective overlying relation to front edges of the side panels.

6 Claims, 4 Drawing Sheets

PROTECTIVE OVERSIZED TOILET SEAT COVER

BACKGROUND OF THE INVENTION

This invention relates generally to toilet seat covers, and more particularly to an improved barrier providing maximum coverage of the sides and front of a toilet.

There is need for improved seat covers well adapted to quick unfolded application to a toilet, and retention in position, for use, and with maximum protective positioning. Also, there is need for the particular preferred cover and its functioning as described herein, for example to protect against children's legs coming in contact with toilet structure.

SUMMARY OF THE INVENTION

It is a major object of the invention to provide an improved, protective cover meeting the objectives as referred to. Basically, the cover comprises:

a) a sheet of foldable flexible material having an overall size to cover the toilet, b) the sheet having a top panel defining a through opening to register with and overlie the toilet bowl, c) the sheet having opposite side panels configured to hang downwardly at opposite sides of the toilet, the side panels having upright front edges, d) the sheet having a front panel configured to hang downwardly at the front of the toilet e) the front panel having spaced edges that extend upwardly and sidewardly to define front panel upper portions separate from the side panels, and that hang in protective overlying relation to front edges of the side panels.

Another object is to provide a cover that self drapes into protective position upon its application to a toilet seat, and wherein the front panel spaced edges are turned to extend sidewardly generally toward one another. As will appear, those spaced edges are preferably curved away from the side panels, encouraging self draping of the front panel into position closing gaps between the front panel and side panels.

A further object is to provide a cover configuration in which elongated folds are formed at the intersections of the top and side panels, those folds extending toward the upwardly and sidewardly extending spaced edges of the front panel. In this regard, the front panel spaced edges are typically curved away from the side panels, and extend beyond lines formed by the intersections of the top and side panels, the sheet having cuts delineating the referenced curvatures.

Yet another object is to locate the cuts between the front and side panels, and to also extend between the front and top panels, for optimum protection.

The sheet may typically consist of soft non-woven fabric having a protective plastic coating.

These and other objects and advantages of the invention, as well as the details of an illustrative embodiment, will be more fully understood from the following specification and drawings, in which:

DRAWING DESCRIPTION

DETAILED DESCRIPTION

Figure 1:
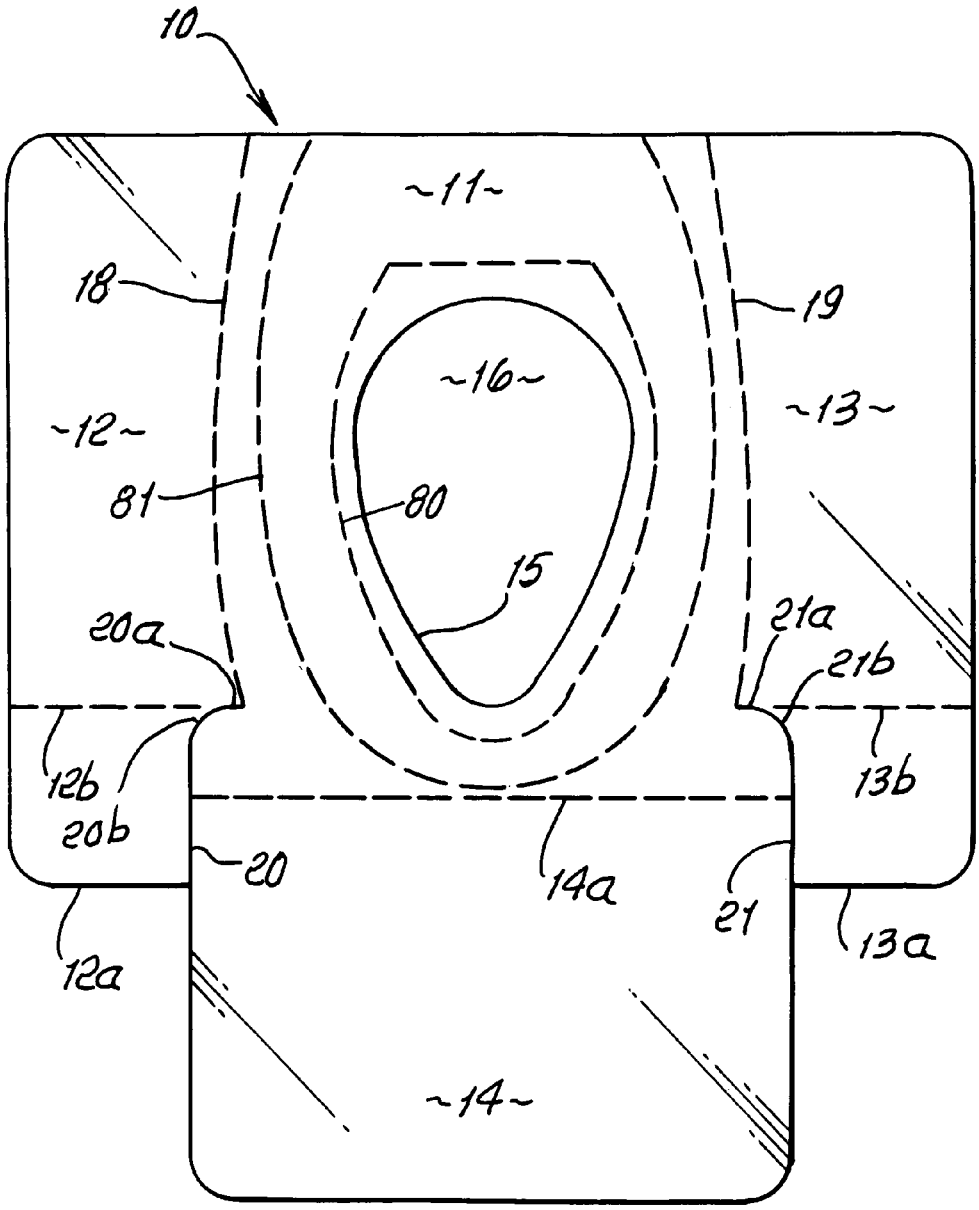
FIG. 1 is a plan view of the cover of the present invention, in spread, flattened configuration, as after unpackaging, and before application to a toilet seat.

In the drawings, a sheet 10 of soft, non-woven foldable fabric having a plastic coating, includes or defines multiple panels 11, 12, 13 and 14. Panel 11 is a top panel defining a through opening 15 to register with and overlie a toilet bowl 16, when the sheet is laid upon toilet structure. Broken lines 80 and 81 are outlines of a toilet seat beneath panel 11. Panels 12 and 13 are opposite side panels that hang downwardly at opposite sides of the toilet structure. Panels 12 and 13 merge with panel 11, and horizontal parallel broken lines 18 and 19 indicate merge zones which are foldable whereby panels 12 and 13 hang downwardly from supporting top panel 11. Panels 12 and 13 have upright frontwardly facing edges 12*a* and 13*a*.

Sheet 10 also has front panel 14 configured to hang downwardly at the front of the toilet structure, as for example from zone 14*a* of horizontal merging with the top panel 11. Broken lines 12*b* and 13*b* in FIG. 1 indicate side flap curvature zones when the side flaps hang downwardly. Broken lines 12*b* and 13*b* are spaced rearwardly from the front edges 12*a* and 13*a* of the side panels.

Figure 2:
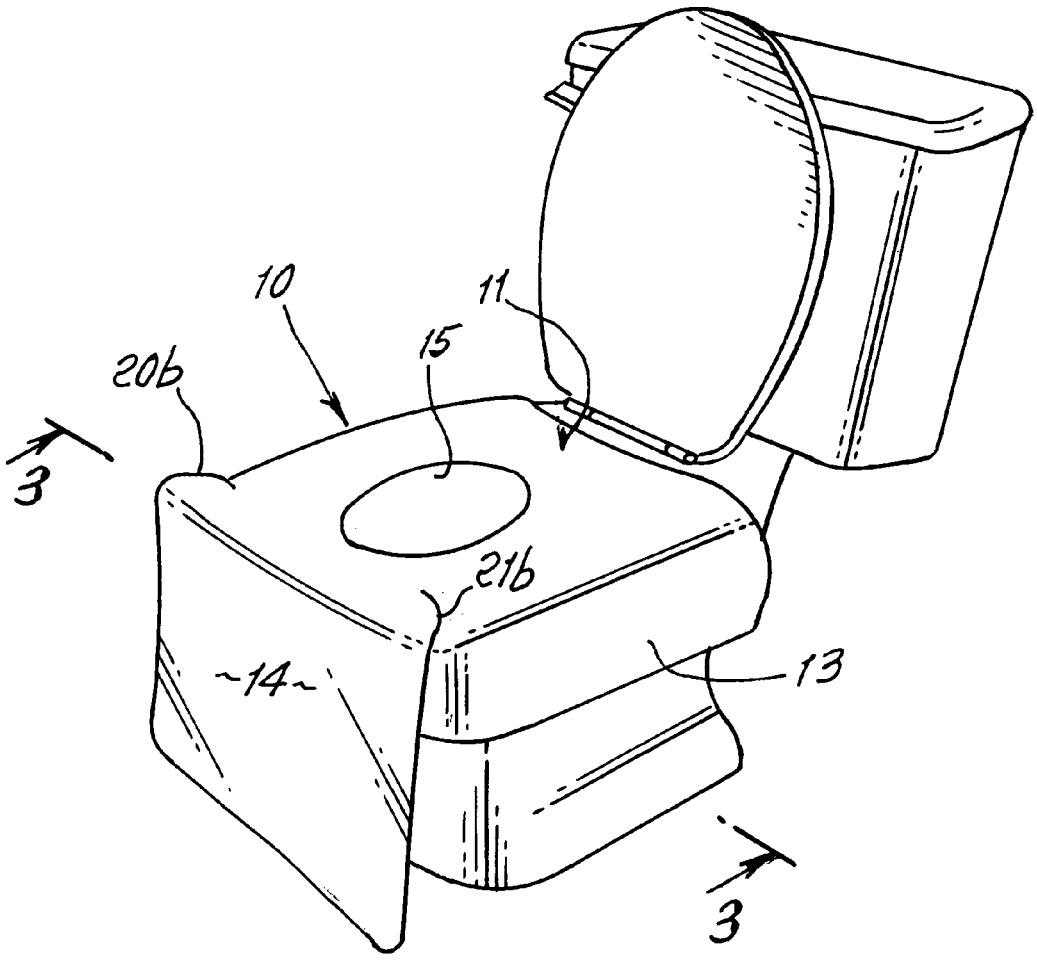
FIG. 2 is a perspective view of the cover in applied position, relative to a toilet seat.

Cuts in the sheet 10, best seen in FIG. 1, are located at 20 and 21 between the front and side panels, with cut extensions 20*a* and 21*a* extending between the front panel and the top panel. Extension 20*a* extends generally normal to cut 20, and the two are connected by locally curved cut 20*b* convex toward line 12*b*. Extension 21*a* extends generally normal to cut 21, and the two are connected by locally curved cut 21*b* convex toward line 13*b*. These local cuts 20*b* and 21*b* may alternatively be angled such as linear, or otherwise turned. Extensions 20*a* and 21*a* which extend toward one another are generally coincident with lines 12*b* and 13*b*, to facilitate functioning of the cover, including protective folding described and to, be described, whereby front panel edge portions in frontward alignment with the cuts are created to hang in protective overlying relation to turned in front edges 12*a* and 13*a* of the side panels, enhancing protection of the toilet structure. See FIGS. 2 and 3. Panel 14 hangs below the levels of the side panels.

Figure 3:
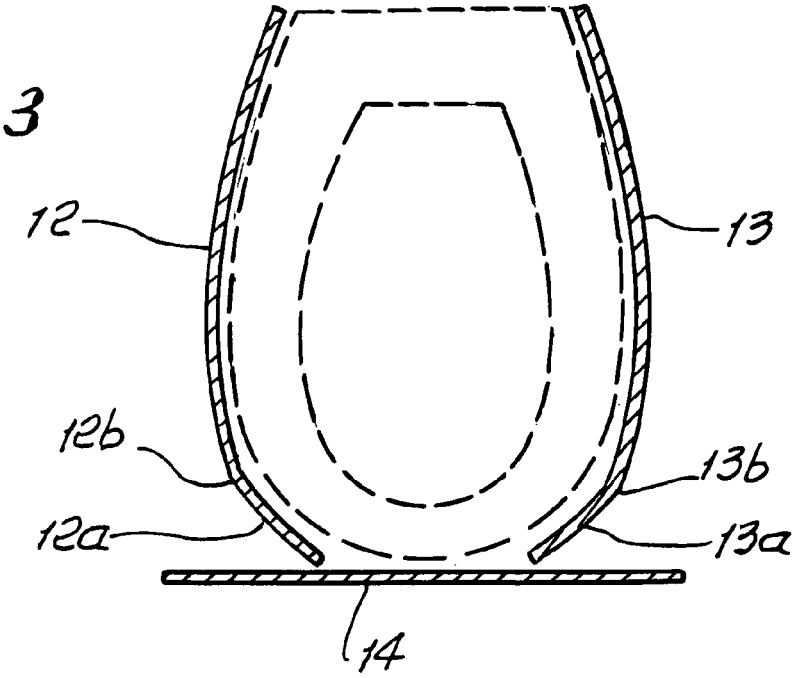
FIG. 3 is a section taken on lines 3-3 of FIG. 2, to show protective draped positions of the front and side panels.
Figure 5:
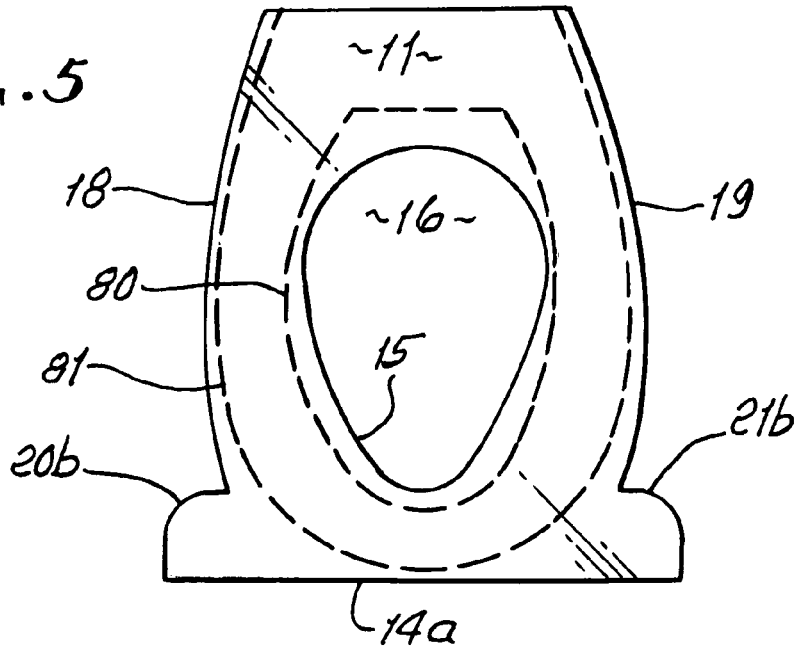
FIG. 5 is a view like FIG. 4, but also showing a toilet seat outline.
Figure 4:
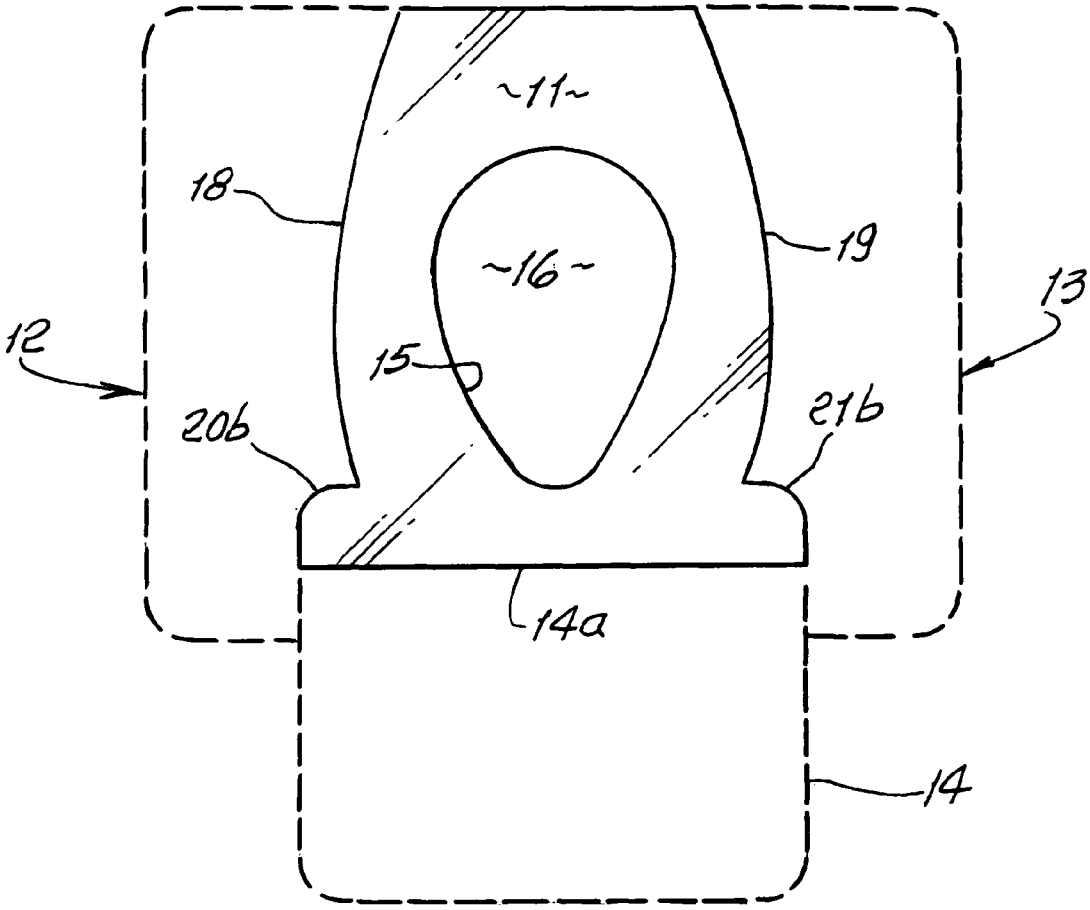
FIG. 4 is a plan view of the cover as applied to a toilet, broken lines indicating hanging elements not shown.

Note in FIGS. 4 and 5 that extensions at 20*b* and 21*b* extend away from the side panels 12 and 13, and in FIGS. 4 and 5 are parallel to the top panel. Also note in FIG. 3 that gaps 30 and 31 are formed by the cuts, between the side panel front edges and the front panel, the gaps being substantially closed by the hanging front panel upper edge portions in response to draping of the sheet over a toilet seat.

Accordingly, the sheet is easily applied to toilet structure, in self-protecting hanging state; and the single sheet is easily folded after use into a compact disposable configuration.

It will further be noted that the installed sheet 10 is easily adjustable, frontwardly and rearwardly to accommodate to different size toilets; and the front panel or flap protectively accommodates to the positioning of the side flaps during such adjustment.

Also, the side flaps and front flap act as counterweights to hold the top panel or seat cover in place, without need for holders such as adhesive tapes or strips.

The material of the sheet 10 may consist of paper, plastic, cloth, fabrics, woven or unwoven fabric, coated or uncoated.

In FIG. 3, the front edges 12*a* and 13*a* may be turned inward in response to engagement against front panel 14.

The apparatus is especially configured for use by children, which is important as enabling the side panels to be grasped form balance purposes. The apparatus also protects against children's legs and/or clothes engagement with the front of the toilet bowl.

I claim:

1. A protective toilet seat cover comprising in combination:

a) a sheet of foldable flexible material having an overall size to cover a toilet seat, b) the sheet having a top panel defining a through opening to register with and overlie the toilet bowl, c) the sheet having opposite side panels configured to hang downwardly at opposite sides of a toilet bowl, the side panels having upright front edges, d) the sheet having a front panel configured to freely hang downwardly at the front of the toilet bowl, e) the front panel having spaced edges that extend upwardly and sidewardly to define front panel upper portions separate from the side panels, and that hang in protective overlying relation to front edges of the side panels, f) and wherein the front panel spaced edges are locally curved away from the side panels and extend toward one another and in a straight path toward an end of said opening, said cover further characterized in that when deployed in a flat plane, each said curved edge is located between said opening and one of said side panel front edges, and wherein each said front panel curved edge is convex toward and is contiguous to a locally concavely curved edge of a side panel, in said flat plane, g) there being forwardly extending, generally parallel cuts between the front panel and the side panels, forwardly of said convex and concavely curved edges thereby defining contiguous forwardly extending side panel and front panel edges in said flat plane.

2. The combination of claim 1 wherein said front panel spaced edges extend sidewardly generally toward one another.

3. The combination of claim 1 wherein said front panel spaced edges are curved away from the side panels at an end of the front panel.

4. The combination of claim 1 wherein elongated folds are formed at the intersections of the top and side panels, said folds extending toward said upwardly and sidewardly extending spaced edges of the front panel.

5. The combination of claim 1 wherein the sheet consists of soft, non-woven fabric having a plastic coating.

6. The combination of claim 5 wherein the sheet is foldable after use, into a compact, disposable configuration.

* * * * *